United States Patent [19]

Dekkers

[11] 4,362,120

[45] Dec. 7, 1982

[54] MOBILE PLATFORM OR PLATFORM TO BE USED AS FLOATING WORKSHOP

[75] Inventor: Cornelis Dekkers, Rotterdam, Netherlands

[73] Assignee: Gusto Engineering B.V., Schiedam, Netherlands

[21] Appl. No.: 181,242

[22] Filed: Aug. 25, 1980

[30] Foreign Application Priority Data

Aug. 24, 1979 [NL] Netherlands ..... 7906403

[51] Int. Cl.[3] ..... B63B 35/44

[52] U.S. Cl. ..... 114/265; 405/198

[58] Field of Search ..... 114/264, 265; 405/196, 405/198, 199; 254/105–112

[56] References Cited

U.S. PATENT DOCUMENTS

| | | | |
|---|---|---|---|
| 2,932,486 | 4/1960 | Suderow | 405/199 |
| 3,056,585 | 10/1962 | Smulders | 405/198 |
| 3,109,289 | 11/1963 | Roussel | 405/198 |
| 3,389,890 | 6/1968 | Bradbury, Jr. | 254/106 |

*Primary Examiner*—Trygve M. Blix
*Assistant Examiner*—Jesus D. Sotelo
*Attorney, Agent, or Firm*—Young & Thompson

[57] ABSTRACT

The invention relates to a platform (1) having a platform (1) and at least three legs (2) movable in vertical direction with respect to the platform (1), the legs (2) being connected to the platform (1) by a lifting and locking mechanism (8,9,17,18,14) having locking bars (8,9) for holding the platform (1) with respect to the legs (2) and lifting jacks (17,18,14) for moving the legs (2) with respect to the platform (1) both locking bars and lifting jacks having elements (8,9,17,18) which can move in and out of engagement with the legs with clearance in vertical direction in recesses (11), safety structure being provided to check the completion of the movements of the elements, the safety structure having a time relay ($t_1$,$t_2$) in the control circuit of the jack system which relay ($t_1$,$t_2$) interrupts the circuit when after a set time which is shorter than the time needed to traverse the clearance in recesses (11), said elements (8,9,17,18) have not reached their final positions, while a recorder (12,13,19,20) of all final positions of the elements (8,9,17,18) also interrupts the circuit when the elements (8,9,17,18) have reached their final positions and also switches off the time relay ($t_1$,$t_2$).

6 Claims, 9 Drawing Figures

Fig-4

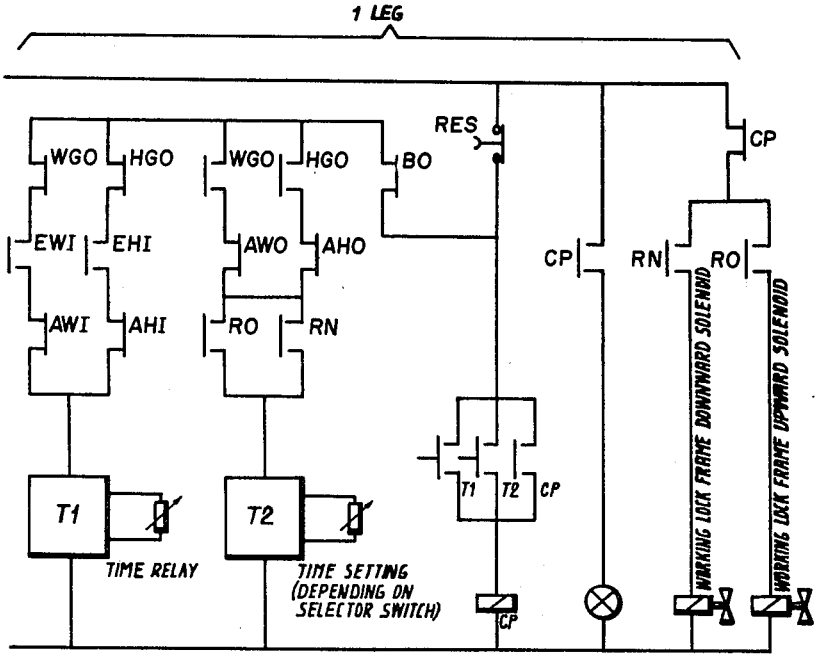

BOTH HOLDING LOCKS IN = AHI
BOTH HOLDING LOCKS OUT = AHO
BOTH WORKING LOCKS IN = AWI
BOTH WORKING LOCKS OUT = AWO
"LIFTING CYLINDER IN COMMAND" = RN
RESET LOCK SAFETY = RES
LOCK SAFETY NOT OPERATING = BO

"LIFTING CYLINDER OUT" COMMAND = RO
FIRST END OF HOLDING LOCK IN = EHI
FIRST END OF WORKING LOCK IN = EWI
"HOLDING LOCKS OUT" COMMAND = HGO
"WORKING LOCKS OUT" COMMAND = WGO

WORKING STROKE FOR LIFTING LEG

WI = WORKING LOCK IN
WO = WORKING LOCK OUT

HI = HOLDING LOCK IN
HO = HOLDING LOCK OUT

MOBILE PLATFORM OR PLATFORM TO BE USED AS FLOATING WORKSHOP

This invention relates to a mobile platform or platform to be used as a workshop, said platform comprising a buoyant pontoon and at least three legs being movable in vertical direction with respect to said pontoon, said legs being connected to said pontoon by means of a lifting-locking mechanism provided in the proximity of each leg, with which mechanism said leg may be secured and moved relative to said pontoon, said mechanism comprising at least two horizontally movable locking means or sets of locking means spaced one above the other, said locking means cooperating with lock recesses of the leg and fitting therein with play in the vertical sense and one locking means or one set of locking means being disposed in a framework, said framework being movable with respect to said pontoon by means of a jack system, said locking means or sets of locking means may act in turn on said leg, and in which each lifting mechanism is provided with a safety means comprising at least one element appertaining to each locking means, said elements recording the final positions of the locking means or sets of locking means when said means have completed their inward and/or outward movement, and in addition a control circuit is provided for the jack system. A mobile platform of this kind is generally known. An example is described in U.S. Pat. No. 3,056,585.

The problem with mobile platforms or platforms to be used as a workshop of this kind is that one has to be absolutely certain whether the locking means have reached their final positions in and out of the locking recesses. There are many reasons why the inward and outward movement cannot take place completely, such as dirt deposits in the recesses of the toothing, faulty cylinders, insufficient pressure in the hydraulic system, etc. Consequently, it is known to dispose means at the region of the final positions, said means recording said final positions. The recording takes place with the aid of switches which are operated by the locking means and which have the function of pilot lights so that the operator can check whether the final positions have been reached. Although this provides a certain amount of safety, this manner of safeguarding does not permit rapid movement of pontoon and leg with respect to each other and, in addition, the limit switches may easily break down.

If the relative vertical movement of the leg with respect to the locking means moving horizontally inwards and outwards is not arrested in time, it may happen that said movement is continued while one end portion of a locking means is still completely or partly in an opening or recess of a tooth. This may cause serious damage.

It is the object of this invention to improve the aforementioned operation and in accordance with the invention said object is achieved in that a time relay is provided in the control circuit of the jack system, said time relay interrupting the circuit when after a previously set time, which is shorter than the time needed to traverse the clearance, the locking means or sets of locking means moving inwards or outwards have not yet reached their final positions, in which the means which record said final positions also control said circuit in such a manner that they interrupt said circuit when all locking means have reached their final positions, and in which also the time relay is switched off.

It is thus achieved that both in the case of automatic and in the case of manual operation the vertical movement is always stopped in time. First of all, said movement is stopped in time when all locking means have reached their final position (either inside or outside of the recess) in the set time. When this does not take place within the set time, the vertical movement will be stopped by means of the time relay.

In the case of a platform in which the horizontally movable locking means of each set of locking means comprise locking bars, the outer end of each locking bar being movable into the recesses of the toothing of spaced rack strips disposed in parallel on the leg and each end portion of said locking bar cooperating with a position indicator, in accordance with the invention, it is preferred that all elements for recording the completion of at least the inward stroke of said bars lying in one plane comprise switches or switching relays which are included in the circuit both in series and in parallel and that the time relay can be energized by one of the switches or relays of the parallel circuit and de-energized by a relay which is energized by the series circuit.

It is thus achieved that the time relay comes into operation as soon as one end portion of a locking bar has reached its correct position, so that the time which is now available for the other end portions of said bars is shorter than the time set on the time relay.

When the locking bars move outwards, the signal for actuating the time relay can also be given by a means which is operated by the end portion of the first locking bar which moves outwards and reaches its proper position.

However, in accordance with the invention it is preferred that all means for recording the completion of the outward stroke comprise serially connected switches or switching relays which, after they have all been made or actuated, energize a relay, said relay interrupting the control circuit, and that the time relay is energized as soon as the command "locking means out" is given. Thus, the starting signal of the time relay is then not given when the end portion of one locking bar has reached its proper position but by the command on the basis of which the operating cylinders move the locking bars outwards.

In addition to constructions in which locking bars are used which, with their outer end portions, can move into rack recesses and which, consequently, run parallel to each other or which are perpendicular to their direction of movement, constructions are known in which the locking means comprise pins which are movable in longitudinal direction, e.g. in radial direction with respect to a cylindrical leg. In the case of the other constructions, but particularly in the case of the construction last mentioned it may be useful in accordance with the invention to dispose two recording means in the proximity of each locking means, said recording means seen in the direction of movement being spaced apart, in which one of said recording means records the final position and the other means records a mid-position, e.g. when the locking means enters the recess of the rack and the recording means last mentioned is connected to a relay, said relay, if required in parallel to other corresponding relays of elements appertaining to locking means lying in the same plane, may energize the time relay and the means recording the final position may de-energize said time relay and interrupt the control circuit by means of a relay, if required in series with corresponding means. This implies that the time relay comes into operation at the moment when the locking means moves into the opening; said locking means should have reached its (their) final position before the time relay comes into operation.

The means for recording the proper positions may comprise mechanically operated switches and relays, e.g. the known switches which are already used for operating pilot lights. Since they are vulnerable it is preferred to use proximity switches, i.e. switches which come into operation when the field of a coil is changed by an approaching mass of metal, such as a locking means.

Instead of switches or relays disposed at the region of the final positions of the locking bars, it is also possible to use position indicators which are disposed in the region of the hydraulic cylinder or cylinders which operate the locking means. They, in turn, may be constituted by switches or switching relays; however, it is preferred that they comprise potentiometers which are connected to the piston of the hydraulic cylinders in such a way that in each position there is a certain voltage which in the case of one or more predetermined values can energize a relay.

The invention will now be explained more in detail with reference to the accompanying drawings, in which.

Figure 5:
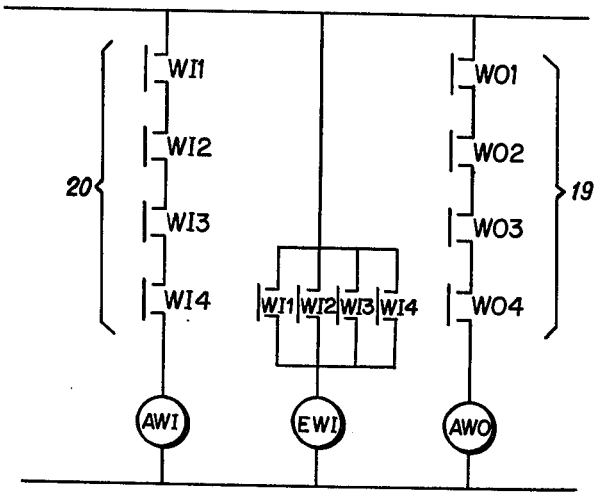
Figure 6:
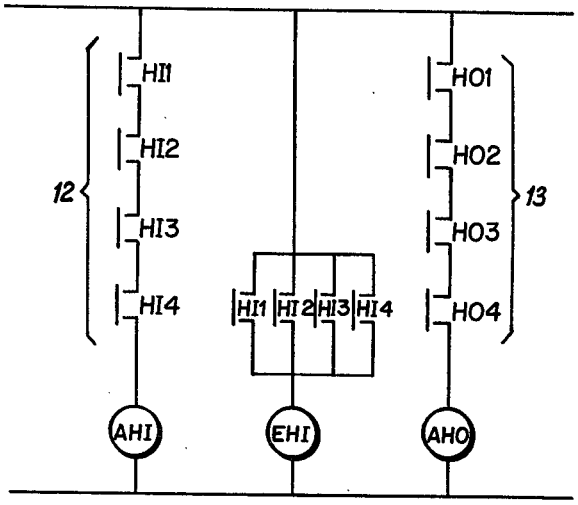

FIGS. 3A–D are diagrams illustrating the various operations to be carried out; and FIGS. 4, 5 and 6 are electrical diagrams.

Figure 1:
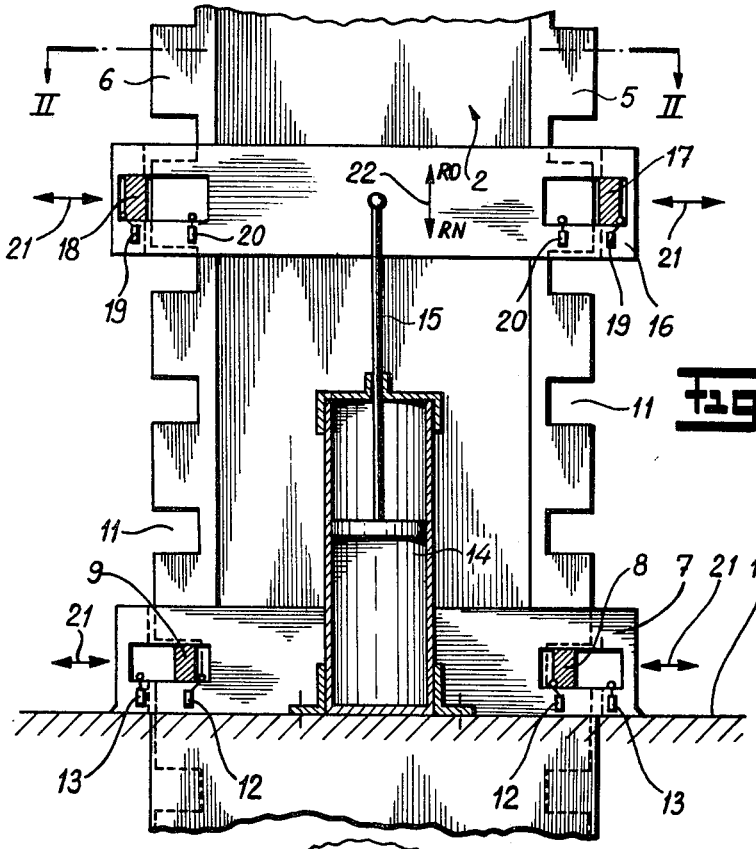
FIG. 1 is a diagrammatic side view of the position of a leg relative to the pontoon and the appertaining locking means and means for effecting the relative movement.

FIG. 1 is a diagrammatic view illustrating a platform 1 having a leg 2. Both side walls 3 and 4 (see FIG. 2) are provided with rack strips 5 and 6 extending beyond the profile. A framework 7 is rigidly secured to the deck of the platform, said framework acting as a carrier of the locking bars 8 and 9 which are moved into and out of the recesses of the racks e.g. with the aid of cylinders 10. The locking bars 8 and 9, referred to hereafter as holding locks, have some play in vertical direction in the recesses 11 of the racks. The play is needed during the mutual vertical movement of the leg and the framework 7 to have space and also time available for the horizontal movement. The switches which record the final position of the holding locks 8 and 9 are indicated by reference numeral 12; reference numeral 13 indicates corresponding switches which record the final position of the holding locks when they have completed their movement out of the recesses. The switches 12 and 13 are preferably disposed in the proximity of the outer ends of the locking bars 8 and 9.

In addition, on either side of each leg the platform 1 carries a lifting means in the form of hydraulically operated cylinders 14, the piston rod 15 of which is connected to a frame 16 carrying the working locks 17 and 18. Limit switches 19 and 20 which indicate the final position of the locking means are available.

The double arrows 21 indicate the movements of the locking bars and arrow 22 indicates the movement of the framework 16.

Figure 2:
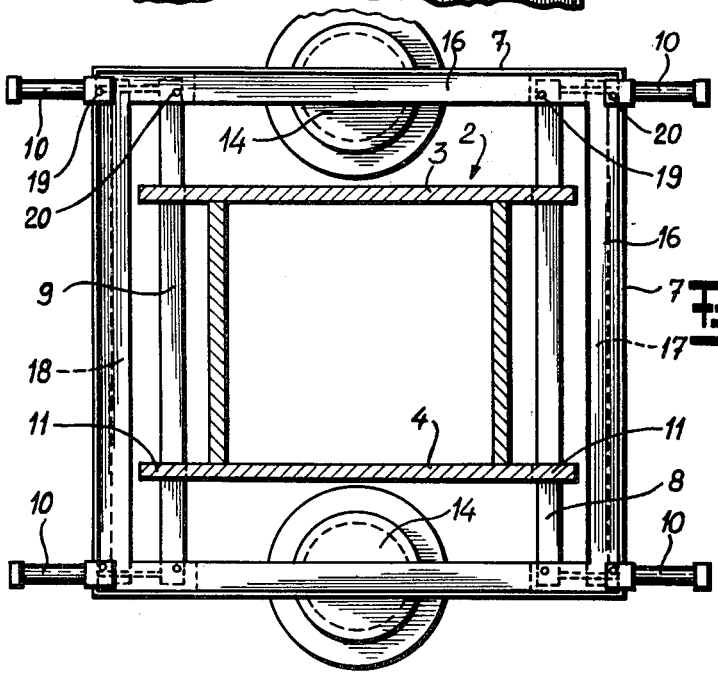
FIG. 2 is a sectional view along line II—II of FIG. 1.

FIG. 2 illustrates the position of the locking bars in frame 16.

When the clearance between the holding locks 8 and 9 and the working locks 17 and 18 in the recess 11 of the rack in vertical direction amounts to 5 cm, said clearance will be traversed at a certain vertical speed; the time this takes depends on said speed and the locking bars (with their outer ends) should have completed their full stroke into and out of the recesses within said time. If this is not carried out successfully, i.e. if a locking bar remains in a recess 11, e.g. with one end portion, or if said bar does not move into the recess completely and the vertical movement is continued the bar will get stuck, as a result of which damage will be caused.

The speed in vertical direction will depend on the quantity per unit time of the oil pump and on which side of the piston in the lifting cylinder the oil is supplied. The supply of oil to the non-rod-side (in the chosen example: frame 16 towards the upper position) gives a speed of e.g. 1.2 cm/s. The supply of oil to the rod-side (frame 16 towards the lower position) gives a speed of e.g. 1.56 cm/s.

When one takes said speed of 1.2 cm/s for the slow movement, the locking means should have completed their movement within 4.17 s.

In the second case with a speed of 1.56 cm/s, 3.21 s are available at any rate for the movement of the locking means.

When the locking means have fully completed their stroke within the above time periods, which serve only as an example, and the switches 12,13 and 19,20 respectively have fulfilled their function as signalling devices, they have not only signalled the requisite final positions (as known by means of pilot lights) but they have also interrupted the circuit which effected the relative movement, i.e. which controlled the lifting cylinders 14, so that the relative vertical movement is arrested.

However, if this is not effected within the set time, accidents and damage occur. Consequently, in accordance with the invention, a time relay is provided which, depending on the situation, i.e. on the time available, is set for a shorter time and is included in the system in such a way that the circuit which controls the lifting cylinders 14 is interrupted when the final-position-signalling devices of the locking bars do not interrupt the circuit within the time intervals of the time relay.

It is thus achieved that in any case the relative vertical movement is stopped within the time period available for the movement of the locking bars during the traversing of the clearance.

FIGS. 3A–D show diagrams showing which cycles of movement can occur, and in which Cycle 1 relates to the lowering of a leg in the case of a floating platform;

Cycle 2 relates to the raising of a leg while the platform is in floating condition;

Cycle 3 relates to the lowering of a platform when the legs are standing on the ocean floor; and Cycle 4 illustrates the raising of the platform when the legs are standing on the ocean floor.

The starting position is indicated at the left side of line 23 and the next starting position which has been reached is indicated at the right side of line 24. The working stroke is illustrated between line 23 and 25 and the so-called resetting stroke is illustrated between line 25 and 24.

In step 1*a* of cycle 1 the holding lock carrying the leg must be moved outwards. To that end, said holding lock should be relieved first, which means that the leg has to be raised. In the case of a play of 5 cm and a vertical relative speed of 1.2 cm/s, 4.17 seconds are available. The time relay is then set at 3.8 seconds. When the outward movement of the holding lock 9 is properly carried out, the situation illustrated in step 1*b* will arise. The leg carried by the working locks 18 is now lowered in accordance with step 1*b'*, whereby halfway through the downward stroke the cylinders which are to move the locking bar 9 inwards into the next recess of the rack are pressurized. As illustrated, the locking bars are then abutted against the rack heads (in step 1*b'* against rack head 6). When the lowering of the leg is continued, said bar will reach the front of the recess of the rack as shown in step 1*c* and it should then move inwards. Since the vertical movement is continued, the inward movement should take place during the traversing of the clearance available; when the clearance amounts to 5 cm and the vertical speed is 1.56 cm/s, the inward movement should take place within 3.21 seconds. The time relay is now set at 3 seconds and when the process has been completed in good order, the position shown in step 1*c'* will be attained.

However, by this time the leg is still being carried by the working lock 18 and not by the holding lock 9.

When the inward movement of the holding lock 9 has taken place without interruptions and delays only part of the clearance available (5 cm) will have been traversed, e.g. 1 cm.

Before the working lock 18 can move outwards, said locking means should have lowered the leg so far that the remaining clearance in the opening in which the holding lock is engaged has been traversed, i.e. the remaining 4 cm in the present example. It is only then that the holding lock has taken charge of the function of carrying the leg and that the working lock can move outwards. The clearance available for said movement is 5 cm in the region of the working lock and it will be traversed at the speed of 1.56 cm/second.

Thus, the vertical downward movement of the frame is continued until the holding lock has taken over; it is only then that the relieved working lock can answer the command to move outwards. Consequently, when the command "working lock out" is given at the moment when the holding lock is moving inwards, the clearance available for the working lock to move outwards amounts to 2×5 cm, so that at a lowering speed of 1.56 cm/s 6.42 s are available.

The time relay which controls the outward movement of the working lock should then be set at 6 seconds.

If the command "working lock out" is given at a different point of time, e.g. when the holding lock has taken full charge of carrying the leg, also a different time is available which only amounts to 3.21 seconds when the clearance available for the working lock amounts to only 5 cm. The time relay appertaining to the working lock should then be set accordingly, e.g. 3 seconds shorter.

The framework 16 is then raised until halfway through the upward stroke the working lock 18 will lie against the rack head of tooth 2 (see FIG. 3A,*d'*) and then move into the recess of the rack. When said movement is effected in vertical direction at a speed of 1.2 cm/s and with a time available of 4.17 seconds, the relay should be set at 3.8 seconds. When said movement has been completed, the starting condition as illustrated at the right side of line 24 is reached again; the starting position is identical to the one shown at the left side of line 23. The only difference is that both the holding lock and the working lock are now in subsequent recesses of the rack.

When the locking bars have reached their final positions, which is recorded by switches or similar devices, within the times set by the time relay, the illustrated sequence of operation could be fully automated, since it is possible in a known way to have each successive operation be controlled by the previous one.

However, when a time relay interrupts the vertical movement because one or more devices which record the final positions detect that the final position has not been reached completely, the vertical movement is stopped. Pilot lights indicate which locking bar is not properly seated. After repair the automatic operation can be started again.

Figure 3A:
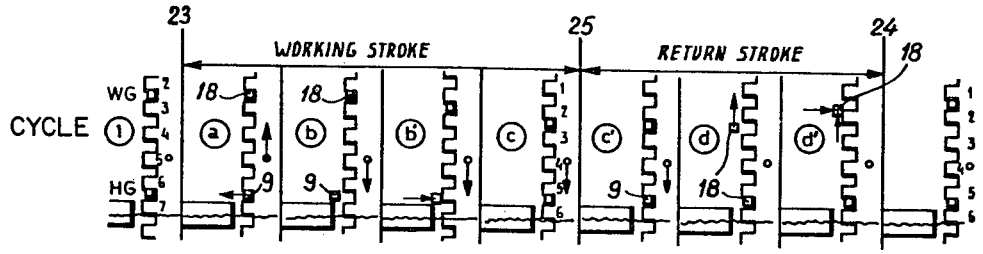
Figure 3B:
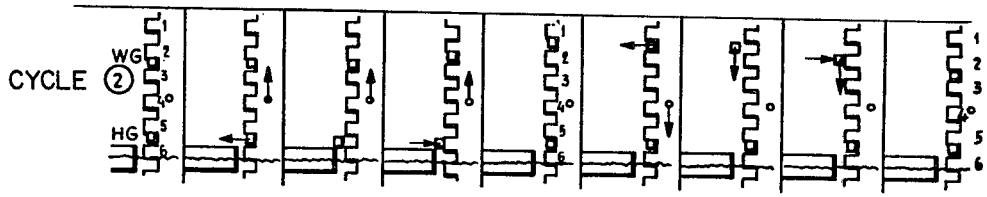

Cycle 2 of FIG. 3B shows the sequence of operations during the lifting of a leg. Also in this case, first of all the lower lock, i.e. the holding lock is moved out of the rack recess, as shown in step 2*a* which corresponds with step 1*a*. However, the vertical movement is continued, as shown in step 2*b* and the holding lock will abut against the head 6 of the rack, as shown in step 2*b'* and will then move into said rack recess, as shown in step 2*c*. Now the holding lock takes over and the working lock moves outwards (see step 2*c'*) and subsequently downwards, against the head 3 of the rack; said working lock will then snap into the recess between teeth 3 and 4, as shown at the right side of line 24 in cycle 2.

Figure 3C:
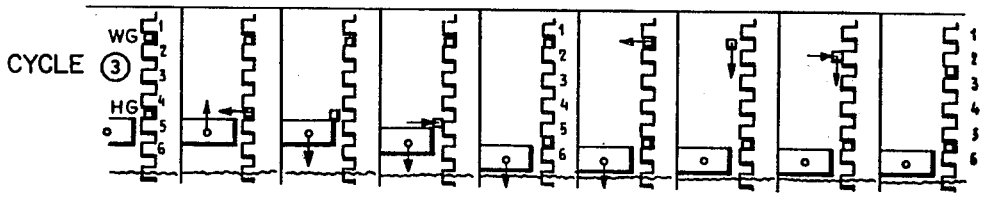

Cycle 3 of FIG. 3C shows the lowering of the platform. In its starting position, said platform rests on the teeth 5 by means of the holding locks. The platform is primarily raised, as shown in step 3*a*, in order to relieve the holding locks and then lowered, in which first of all the holding lock will abut against the head of tooth 5 (as shown in step 3*b'*) and it will then snap into the recess between teeth 5 and 6 (as shown in step 3*c*); when the holding lock has traversed the clearance and is properly seated in said recess it will take over the function of carrying the platform. Thereafter, in accordance with steps 3*c'*, *d* and *d'* the working lock can be shifted into the subsequent lower recess. The starting position has then been reached again.

Even in this case it is true that double clearance and, consequently, time is available for the working lock when it receives the command "out" at the moment when the holding lock moves inwards. However, the speed is not the same, e.g. 1.2 cm/s and the time available in the case of a clearance of 2×5 cm is 8.34 s, so that the time relay for the working lock should be set at 8 seconds.

Figure 3D:
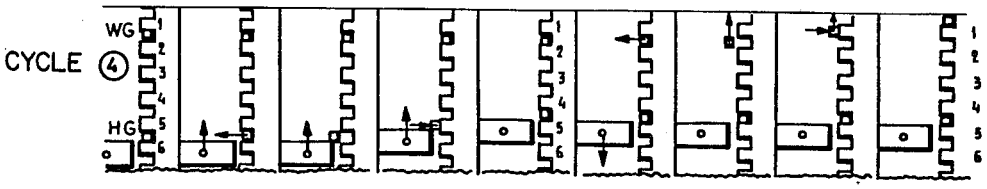

Cycle 4 of FIG. 3D shows the lifting of the platform. In its starting position (see cycle 4 at the left side of line 23) the platform and the holding locks rest on the leg. In accordance with step 4*a* the platform is raised, as a result of which the holding lock is relieved; this procedure is possible because the platform is suspended from the framework 16 by means of cylinders 14, said framework being in engagement with the toothing of the leg by means of the working locks 17 and 18.

In cycle 4, steps 4*b* and *b'* show positions in which primarily the holding lock leaves the toothing and subsequently abuts against the head of tooth 5. Step 4*c* shows the situation in which the holding lock enters the recess of a tooth again. When this operation has been completed, the platform will be lowered again (see step 4*c'*) so that the holding locks can take over the function of carrying the platform; the working locks will then leave the recess of the tooth (shown in steps 4c', d and d') and they will move towards a higher recess until the starting position has been reached again.

The diagrams shown in FIG. 4, 5 and 6 will now be described.

The diagram shown in FIG. 4 comprises time relays $t_1$ and $t_2$ and a number of switching relays in their starting position.

FIG. 5 illustrates the way in which the limit switches and means for monitoring the final positions via switches or switching relays influence the switching relays (shown in the diagram of FIG. 4) for the working locks. FIG. 6 shows the same for the holding locks.

FIG. 4 shows the purpose of the relays in the diagram.

When the commands "holding locks out" and "lifting cylinder in" (which means that the framework 16 is being lowered) are given simultaneously, the open switches HBO and RN are closed (see FIG. 4). In doing so, the time relay $T_2$ will be energized.

When the holding locks move outwards, they will operate switches 13. Said switches are shown in FIG. 6 in the form of four serially connected switches or switching relays H01, H02, H03 and H04. As soon as all four switches have been operated, i.e. the four outer end portions of the holding locks have been moved outwards, the relay AHO is energized. This means that in the operating chain the switch AHO, which is shown in closed position in FIG. 4, will open. The circuit is then interrupted. When the interruption does not take place within the time specified, i.e. the time set at time relay $T_2$, said time relay will interrupt the circuit.

A similar situation arises when during the command "holding locks out" also the command "lifting cylinder out" is given, which means that apart from HGO also RO is being closed.

Thus, in both cases time relay $T_2$ is used.

In the case of the working locks the following situation occurs.

The command "holding locks in" was already given as a function of a switch (not shown and not described) which indicates that during the vertical movement half the stroke has been completed so that the cylinders which have to move the locking means will start pressing them against the tooth head. As soon as the first locking bar end of a holding lock can enter a tooth recess, it will do so and when the inward stroke has been completed, said position will be recorded by the relevant means, such as limit switch. This means that one of the parallel-running switches HI1, HI2, HI3 or HI4, shown in the diagram of FIG. 6, is closed. In the diagram of FIG. 4 the EHI is made and, consequently, time relay $T_1$ is energized. It is only when all four serially connected switches 12 indicated by reference numerals HI1, HI2, HI3 and HI4 have been made that relay AHI is energized; this signal indicating that both holding locks have moved completely inwards will interrupt the circuit again in that AHI is opened. When this does not take place within the set time, time relay $T_1$ will provide the interruption.

A comparable situation is shown in FIG. 5. All limit switches 19 for the working locks which have to record their outside position are indicated by reference numerals WO1, WO2, WO3 and WO4 and all switches 20 which record the position inside are indicated by reference numerals WI1, WI2, WI3 and WI4. The switches last mentioned are provided in a parallel connection and in a series connection. By energizing relay EWI during the energization of time relay $T_1$ and the series connection of all serially connected switches 20/WI1–WI4, the parallel connection determines again the interruption of the circuit via relay AWI. When the working locks move outwards the command is given by closing WGO in combination with RO or RN, so that at the same time relay $T_2$ is actuated, and the signal AWO is given which means that both working locks are out since all switches 19/WO1 up to and including WO4 are made.

It is conceivable to use recording apparatus in the form of a switch which records the moment at which the locking means enters a tooth recess, said switch being provided between switches 19, 20 and 12, 13 respectively. Said switch is included in the circuit in such a way that the time relay is energized.

I claim:

1. In a mobile platform comprising a buoyant pontoon and at least three legs movable in vertical direction relative to said pontoon, said legs being connected to said pontoon by means of a lifting-locking mechanism provided in the proximity of each leg, with which mechanism said leg can be secured and moved relative to said pontoon, said mechanism comprising at least two horizontally movable locking means spaced one above the other, said locking means cooperating with lock recesses of the leg and fitting therein with clearance in vertical sense and one locking means being disposed in a framework, said framework being movable with respect to said pontoon by means of a jack system, said locking means being adapted to act in turn on said leg, and in which each lifting-locking mechanism is provided with a safety means comprising at least one element appertaining to each locking means, said elements recording the final positions of the locking means when said means have completed their movement, and a control circuit for the jack system; the improvement comprising a time relay in the control circuit of the jack system, said time relay interrupting the circuit when, after a previously set time which is shorter than the time needed to traverse said clearance, the locking means moving inwards and outwards have not yet reached their final positions, said elements which record said final positions also controlling said circuit in such a manner that they interrupt said circuit when all locking means have reached their final positions, and in which also the time relay is switched off.

2. Platform in accordance with claim 1, in which the horizontally movable locking means comprise locking bars, the outer end of each locking bar being movable into the recesses of the toothing of spaced rack strips disposed in parallel on the leg and each end portion of said locking bar cooperating with a said recording element, all said elements for recording the completion of at least the inward stroke of said bars lying in one plane comprising switch means which are included in said circuit both in series and in parallel, said time relay being adapted to be energized by one of said switch means of the parallel circuit and de-energized by a relay which is energized by the series circuit.

3. Platform in accordance with claim 2, in which all said elements for recording the completion of the outward stroke comprise serially connected switch means which, after they have all been made, energize a relay, said relay interrupting the control circuit, the time relay being energized as soon as the locking means begin to move outwards.

4. Platform in accordance with claim 1, and two said elements disposed in the proximity of each locking means, said recording elements, seen in the direction of horizontal movement being spaced apart.

5. Platform in accordance with claim 1, in which said elements comprise mechanically operated switches and relays.

6. Platform in accordance with claim 1, in which said elements comprise proximity switches.

* * * * *